US005080006A

United States Patent [19]

Vonsick

[11] Patent Number: 5,080,006

[45] Date of Patent: Jan. 14, 1992

[54] CHIMNEY DAMPER DEVICE

[76] Inventor: Hal A. Vonsick, 912 Southview Rd., Louisville, Ky. 40214

[21] Appl. No.: 316,021

[22] Filed: Feb. 27, 1989

[51] Int. Cl.[5] ..... F23L 11/00

[52] U.S. Cl. ..... 454/7; 126/286

[58] Field of Search ..... 126/285 R, 286, 536; 98/59

[56] References Cited

U.S. PATENT DOCUMENTS 3,945,307 3/1976 Lyemance ..... 126/286

4,165,679 8/1979 Lyemance ..... 126/286

*Primary Examiner*—Carroll B. Dority

*Attorney, Agent, or Firm*—Edward M. Steutermann

[57] ABSTRACT

The present invention provides a new and useful arrangement for use in a pivotable chimney dampers of the type including a damper flap to selectively open and close the outlet from the flue of a chimney where the damper flap is pivoted and includes bias means to urge the damper flap to a normally open position with respect to a frame which surrounds the flue when the damper is unrestrained and where a flexible connection is provided to be attached at a first location to the damper flap to pull the damper flap to a closed position against the frame member when the pull means is drawn tight. An expansible spring means can be attached between the damper flap and the pull means to be pulled to extended position when the damper flap is closed. In accordance with the present invention the flexible connector is joined to the pull at a location below the spring and a bracket is provided to extend outwardly from the inside of the flue and has a guide to receive the flexible connector to direct the flexible pull so the damper flap at a second location pulling the flexible connector urges the damper toward open position where the length of the flexible connector is such that upon selected extension of spring means the flexible connector becomes taught and the force exerted on the second location is in excess of the force exerted on the first location so the damper flap is urged toward open position.

3 Claims, 1 Drawing Sheet

CHIMNEY DAMPER DEVICE

BACKGROUND OF THE INVENTION

While providing means for the escape of products of combustion from an associated fireplace, the flue of a chimney also presents an opening for the undesirable admission of rain, sheet, snow, insects, animals, and birds to the associated fireplace. In addition, significant heat loss occurs through the flue of a chimney when there is no fire in the fireplace.

Accordingly, it has been found highly desirable to provide damper means to close off the flue when there is no fire in the fireplace. Various means are known for closing the flue of the chimney when the fireplace is not in use including the well known firebox damper has been used extensively and other prior arrangements as illustrated in U.S. Pat. Nos. 2,704,502, 2,856,839, 3,267,832 are well know in the art.

In addition U.S. Pat. No. 3,945,307 Lyemance, shows a normally open damper arrangement to be located at the floor outlet which includes a sealing arrangement to prevent leakage of rain or snow into the chimney. Further, the seal reduces heat loss from the chimney.

U.S. Pat. No. 4,165,679 Lyemance provides one improvement on the structure of U.S. Pat. No. 3,945,307 and the present invention provides further improvement of the structure taught in U.S. Pat. No. 4,165,679.

Most previous arrangements, other than the aforenoted Lyemance arrangements, have allowed wind blow rain to enter a flue even through the damper located at the top of the flue has been closed. Further, in most prior art arrangements the damper is normally closed and is opened to allow the use of the flue, contrary to the present invention. In the event a fire is built in the fireplace without opening the damper the building associated with the fireplace is filled with smoke.

While devices in accordance with the Lynemance teachings was satisfactorily the present invention further improves the operation of such devices and particularly the opening of such devices when stuck closed.

SUMMARY OF THE INVENTION

The present invention provides an improvement use in damper arrangements received at the top of a chimney where a generally rectangular frame defines a flue opening from the chimney and a damper flap is pivotably mounted on the frame devices to prevent wind blown rain as well as animals and other unwanted objects from entering the flue. Devices within the scope of the present invention provide a straight forward arrangement to force release of the damper in the event it freezes in closed position. The Lyemance U.S. Pat. No. 4,165,679 has taught the use of a safety chain and the present invention provides an enhancement of that arrangement to specifically direct the force which is associated with the pulling of the damper chain.

Briefly, the present invention provides a new and useful arrangement for use in a pivotable chimney dampers of the type including a damper flap to selectively open and close the outlet from the flue of a chimney where the damper flap is pivoted and includes bias means to urge the damper flap to a normally open position with respect to a frame which surrounds the flue when the damper is unrestrained and where a flexible is provided to be attached at a first location to the damper flap to pull the damper flap to a closed position against the frame member when the pull means is drawn tight.

An expansible spring means can be attached between the damper flap and the pull means to be pulled to extended position when the damper flap is closed. In accordance with the present invention the flexible connector is joined to the pull at a location below the spring and a bracket is provided to extend outwardly from the inside of the flue and has a guide to receive the flexible connector to direct the flexible pull so the damper flap at a second location pulling the flexible connector urges the damper toward open position where the length of the flexible connector is such that upon selected extension of spring means the flexible connector becomes taught and the force exerted on the second location is in excess of the force exerted on the first location so the damper flap is urged toward open position.

In accordance with the present invention a flexible connector is joined to the pull means at a location below the spring means and the damper flap at a second location where pulling the connector urges the damper toward open position where the length of the flexible connector is such that upon selected extension of spring means the flexible connector becomes taught and the force exerted on the second location is in excess of the force exerted on the first location so the damper flap is urged toward open position.

Examples, of arrangements within the scope of the present invention are illustrated in the accompanying drawings and described hereinafter but it will be understood that the arrangements shown and described are by way of example and not by way of limitation and that various other arrangements also within the scope of the present invention will occur to those skilled in the art upon reading the disclosure set forth hereinafter.

BRIEF DESCRIPTION OF THE DRAWINGS

Referring now to the drawings which illustrate and arrangement within the scope of the present invention.

DETAILED DESCRIPTION OF THE DRAWINGS

Figure 1:
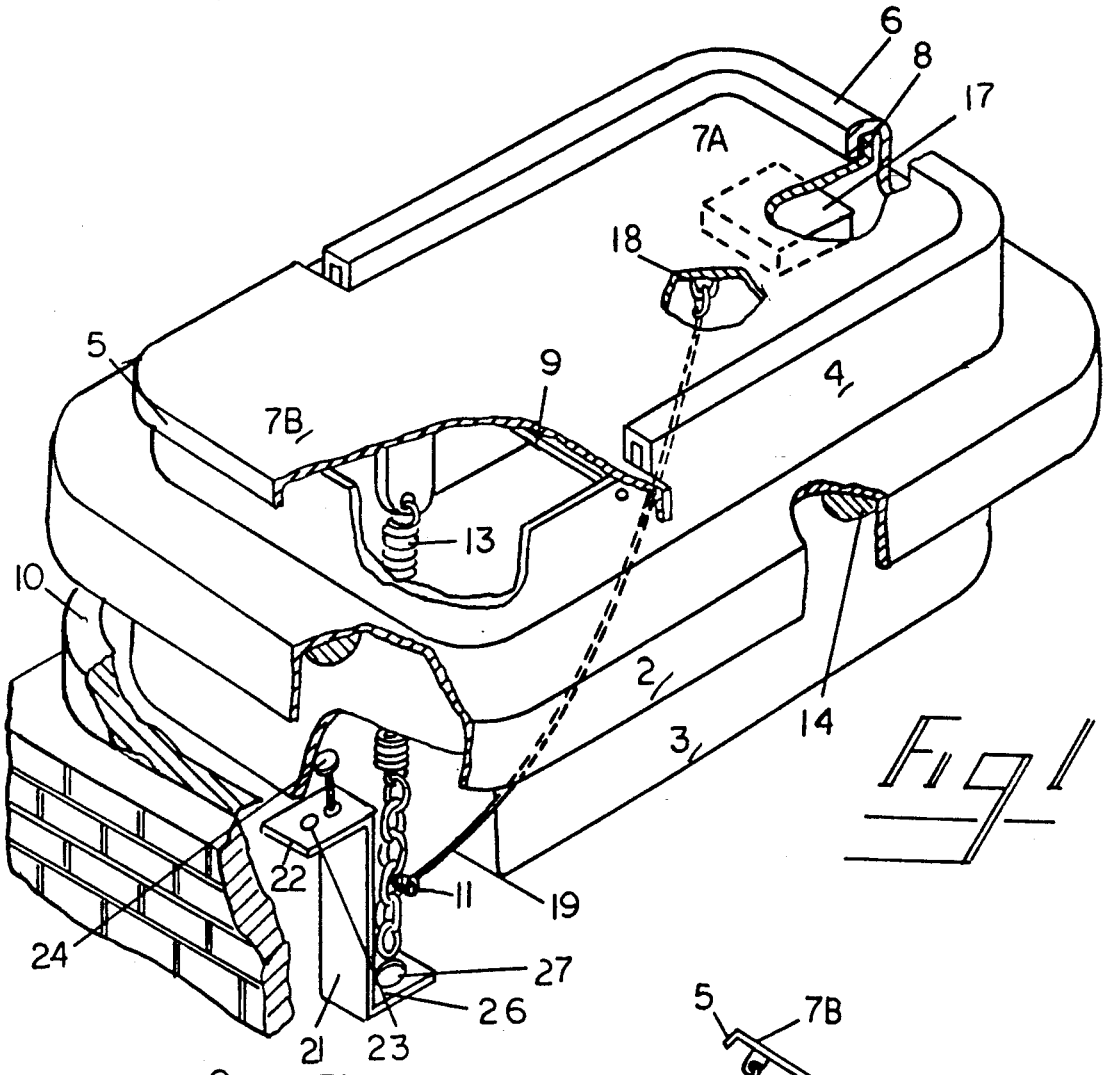
FIG. 1 shows a perspective view partly in section of one example of a damper in accordance with the present invention as described hereinafter.

The example of the present invention shown in FIG. 1, includes a generally rectangular frame member 1 which is provided to rest on the top of the chimney at the outlet of the flue of a chimney (not shown) in which the damper arrangement is installed. A depending flange 2 can be provided to extend downwardly from frame 1 over the outer surface of the chimney flue. Frame 1 likewise includes an upstanding generally rectangular flange 4 provided with an inverted channel member 6 at the top edge thereof, which extends partially around the periphery of flange 4 as shown. A sleeve 3 can be provided, as shown, to extend downwardly into the flue liner adjacent the walls of the chimney.

As shown, damper flap 7 is provided to be pivotably mounted in cooperation with flange 4 for example by means of a pivot 9. Pivot 9 is advantageously journaled, for example in flange 4 so that when damper flap 7 is unrestrained, the damper flap is rotatable in a clockwise direction out of engagement with channel 6 to a generally vertical open position exposing the opening defined by flange 4 and the chimney flue. A weight 17 can be provided to provide additional force tending to open flap 7.

As shown, section 7B of damper flap 7 includes a downwardly extending lip 5 which can, advantageously extend substantially around the portion of damper flap 7 which extends beyond the limits of flange 4. An upstanding flange 8 is provided around a portion of the periphery of flap 7 to be received in channel 6 to provide a seal between flange 4 and damper 7 extending substantially around flange 4 and the periphery of damper 1 from one end of pivot 9 to the other.

A bracket 12 can be provided on the underside of flap 7 to be connected to a flexible damper pull means, for example a chain or cable 11 by means of an expansible spring 13. Chain or cable 11 extends downwardly through the chimney to a fireplace associated with the chimney for closing damper 7 and can be retained therein to hold damper 7 in closed position by latch means (not shown).

Spring 13 is provided to provide a selected tension when chain 11 is pulled after damper 7 is closed, to provide a bias force to hold damper 7 in a closed position in sealing relation with flange 4.

Additionally, spring 13 also provides means, as described hereinafter to alleviate the force components on damper 7 to release damper 7 where damper flap 7 is frozen or stuck closed.

In accordance with one feature of the present invention a bracket 21 is provided with a leg 22 extending outwardly from one side thereof with holes 23 to receive bolts 24 to hold the bracket to frame 10 with the leg 21 in vertical position as shown. A foot 26 extends outwardly from leg 21 and has hole 27 to receive, and guide, cable 16 as described hereinafter.

A sealing compound 14 can be provided on the underside of frame 1 between flange 2 and sleeve 3 to seal the underside of flange 1 to the top of the chimney to which the apparatus is place. In the alternative bolts (not shown) can be provided to extend through cooperative openings in sleeve 3 and fastened to the chimney flue to secure the damper arrangement in place.

In operation, frame 1 is received on the chimney, to which the damper arrangement to be installed, with flanges 2 extending downwardly along the outer surface of the chimney while a sleeve 3 is received by the flue defined within the chimney.

The normally open characteristic can be achieved by locating pivot 9 off center so that the portion 7A of damper flap 7 opposite bracket 12 in portion 7B of damper flap 7 is heavier so that flap 7 pivots about pivot 9, when unrestrained to fall to the open position. If faster or more certain action is desired, a weight 17 can be added to portion 7A of flap 7 to accentuate the offcenter effect of pivot 9.

Damper flap 7 as previously described is normally open is closed by pulling chain 16 so that spring 13 is extended to overcome the weight of damper flag 7A and weight 17. The chain is fasten to suitable fastener means and which is located within the fire box in the fireplace (not shown).

As further previously described, connector 11 can then be pulled further to extend spring 13 to provide a resultant force urging damper flap 7 into closed position.

Upon release of chain 11 damper flap 7 is then rotated by gravitational force, resulting from the location of pivot 9 to an open position extending generally vertically into collar 3 and the chimney flue so that the flue is open and ready for use. It will be noted that in the event spring 11 breaks damper flap 7 will always "fail safe" by rotating to an open position so that the chimney is available for use. In prior art arrangements where the damper is opened by pulling a chain or similar means considerable difficulty is experienced when the chain breaks so the damper returns to a normally closed position. Extreme difficulties arise when the opening means break after a fire is already set in the associated fireplace.

Figure 2A:
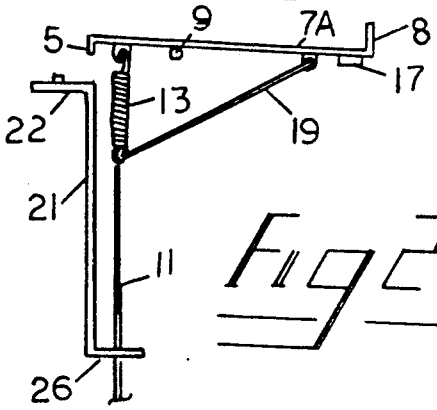
FIGS. 2A–2B, present a schematic illustration of operation of the arrangement shown in FIG. 1.
Figure 2B:
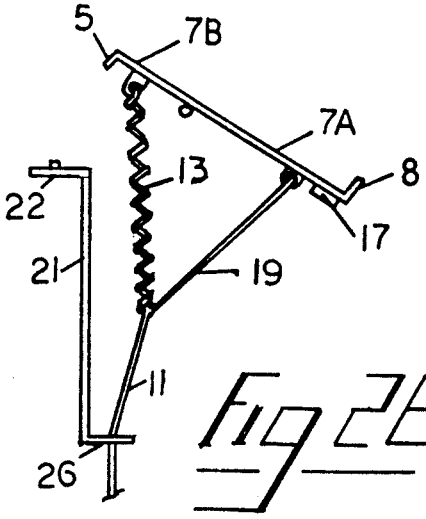

In accordance with one feature of the present invention, as illustrated in FIG. 2B, when damper flap 21 is stuck closed so that it does not open by gravity chain 11 is pulled to extend spring 13, but connector 19 is also pulled taught and the point of application of force by chain 11 is determined by the length of connector 19. In toward an area beneath the center of damper 21. In accordance with the features of the present invention it has been found that by using the guide assembly 21 and feeding the chain 16 through guide 27 the portion of the force exerted by chain 16 on connector 18 increases to greatly enhance the force tending to open the damper.

It will be understood that the foregoing examples are by way of limitation only and that other arrangement also within the scope of the present invention will occur to those skilled in the art upon reading the disclosure set forth hereinbefore.

The invention claimed is:

1. A chimney flue damper and closure arrangement including:

a. frame means of substantially rectangular shape to be disposed adjacent the outlet from a chimney flue defining an outlet from said chimney flue;

b. damper flap means pivotably carried by said frame means to rotate from a first position closing said opening defined by said frame means to a second position wherein a first portion of said damper flap means is disposed within said chimney flue and a second portion of said damper flap means is rotated to a position extending outwardly from said frame means so said opening defined by said frame is open to flow of fluid from said chimney flue;

c. pivot means connected to said damper flap means and said frame means to pivotably connect said damper flap means to said frame means to said damper flap is rotatable between said first position and said second position;

d. bias means to urge said damper flap means to said second position when said damper is unrestrained;

e. flexible pull means connected to said second portion of said damper flap to pull said damper flap from said second position to said first position where said flexible pull means is connected to said damper flap by spring means connected at a first end to said damper flap and at a second end to said flexible pull means; and f. guide means including a bracket attached to said frame means where said bracket has a distal end located in said flue a selected distance from said frame and extending outwardly into said flue where an aperture is provided in said distal end with said flexible pull means extending therethrough so that when said flexible pull is pulled said spring is held generally parallel to said flue.

2. The invention of claim 1 wherein:

a. an underside of said second portion of said damper flap is adapted to engage an outlet edge of said frame means and second portion of said damper flap means extends beyond the periphery of said portion of said frame means engaged by said second portion of said damper flap means; and b. said second portion of said damper flap includes downwardly extending lip means around a portion of said second portion of said damper flap.

3. The invention of claim 1 wherein said first portion of said damper flap means is heavier than said second portion of said damper flap means so said first portion of said damper flap, when unrestrained rotates about said pivot means to open the opening defined by said frame means.

* * * * *